US011841215B2

(12) United States Patent
Allison et al.

(10) Patent No.: US 11,841,215 B2
(45) Date of Patent: Dec. 12, 2023

(54) MODULAR SCALABLE EFFECT MUNITION

(71) Applicant: The United States of America, as represented by the Secretary of the Navy, Crane, IN (US)

(72) Inventors: Lucas Allison, Madison, AL (US); Michael H. Jones, Bedford, IN (US); Calvin Lawson, Springville, IN (US); Lucius A. Taylor, IV, Crane, IN (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/696,144

(22) Filed: Mar. 16, 2022

(65) Prior Publication Data

US 2022/0307807 A1 Sep. 29, 2022

Related U.S. Application Data

(60) Provisional application No. 63/164,736, filed on Mar. 23, 2021.

(51) Int. Cl.
*F42B 23/24* (2006.01)
*F42B 23/14* (2006.01)
(Continued)

(52) U.S. Cl.
CPC ..... *F42B 23/24* (2013.01); *F42B 3/28* (2013.01); *F42B 23/10* (2013.01); *F42B 23/14* (2013.01); *F42B 3/00* (2013.01); *F42B 3/26* (2013.01)

(58) Field of Classification Search
CPC .... F42B 1/00; F42B 1/02; F42B 1/028; F42B 1/032; F42B 1/036; F42B 1/04;
(Continued)

(56) References Cited

U.S. PATENT DOCUMENTS 4,213,391 A * 7/1980 Drimmer ..... F42B 23/04 102/401
5,036,771 A * 8/1991 Alford ..... F42B 3/08 102/307

(Continued)

FOREIGN PATENT DOCUMENTS

DE 3344601 C2 * 10/1988 ..... F42B 23/24
EP 3344946 B1 * 8/2019 ..... F42B 1/02

OTHER PUBLICATIONS

Machine translation of EP-3344946-B1 (Year: 2019).*
Machine translation of DE-3344601-C2 (Year: 1988).*

*Primary Examiner* — James S Bergin
(74) *Attorney, Agent, or Firm* — Naval Surface Warfare Center, Crane Division; Christopher Feigenbutz

(57) ABSTRACT

Provided is a modular directional charge system that can be assembled in different configurations depending on the target. The system includes a removable energetic material, a molded plastic shell comprising a main body and a front cover, a removable fragmentation insert, a removable breaching insert, an initiator well insert, and initiator adapter nuts. The main body comprises an internal energetic material receiving compartment, a first and second tripod mount, a threaded adapter, and a pair of pin receivers, while the front cover comprises an internal removable insert compartment. The main body and front cover are held together with a multi-position adjustable toothed locking interface that adjustably permits the cover to intimately contact the energetic material when the internal removable insert compartment contains a fragmentation insert, a breaching insert, or no insert at all. A method of use is also provided.

8 Claims, 5 Drawing Sheets

(51) Int. Cl.

| | |
|---|---|
| ***F42B 23/10*** | (2006.01) |
| ***F42B 3/28*** | (2006.01) |
| ***F42B 3/00*** | (2006.01) |
| ***F42B 3/26*** | (2006.01) |

(58) Field of Classification Search

CPC ..... F42B 3/00; F42B 3/08; F42B 3/22; F42B 3/28; F42B 23/00; F42B 23/04; F42B 23/08; F42B 23/10; F42B 23/14; F42B 23/24; F42B 3/26; F42D 1/00; F42D 3/00; F42D 3/04

USPC ..... 102/401, 416, 424

See application file for complete search history.

(56) References Cited

U.S. PATENT DOCUMENTS

| | | | | |
|---|---|---|---|---|
| H1504 | H * | 12/1995 | Crabtree | F42B 12/10 102/476 |
| 6,298,788 | B1 * | 10/2001 | Woods | F42B 12/36 102/447 |
| 7,000,545 | B2 * | 2/2006 | Sansolo | F42B 3/00 102/305 |
| 7,299,735 | B2 * | 11/2007 | Alford | F42B 33/062 89/1.13 |
| 7,337,703 | B2 * | 3/2008 | Sansolo | F42B 1/036 102/307 |
| 8,037,828 | B1 * | 10/2011 | Jakaboski | F42B 1/02 102/305 |
| 10,222,182 | B1 * | 3/2019 | Cardoza | F42B 1/02 |
| 10,408,589 | B1 * | 9/2019 | Chen | F42B 33/001 |
| 2016/0216085 | A1 * | 7/2016 | Scheid | F42B 3/22 |

* cited by examiner

MODULAR SCALABLE EFFECT MUNITION

CROSS-REFERENCE TO RELATED APPLICATIONS

The present application claims priority to U.S. Provisional Patent Application Ser. No. 63/164,736, filed Mar. 23, 2021, entitled "Modular Scalable Effect Munition," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200635US02) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of invention relates generally to directional charges. More particularly, it pertains to a non-energetic modular directional charge system that contains components that can be assembled in different configurations depending on the target.

BACKGROUND

Current methods of entry and assault require a user to approach a target and manually breach/neutralize the target. This process places the user in an exposed position, which may result in injury/incapacitation, possibly limiting mission/objective success. Problems related to current directional charges that are known and available include their lack of customization based on a particular task, which often leads to unintended collateral damage. Additionally, directional charges are pre-assembled, requiring the user to carry energetic materials, which increases the chance on inadvertent initiation due to enemy combatant munitions.

Furthermore, new advances in unmanned systems that can be sent downrange to assault a target have, in some instances, eliminated the need for a user approaching the target and manually emplacing munitions to breach/neutralize the target. A directional charge that is designed for use with unmanned systems would allow for remotely placing a breaching charge or delivering an energetic payload where the user is protected from enemy combatant attack while clearing a door/wall or assaulting a barricaded enemy combatant.

SUMMARY OF THE INVENTION

Provided is a modular directional charge system that contains various components that can be assembled in different configurations depending on the target. The system includes a removable energetic material, a molded plastic shell comprising a main body and a front cover, a removable fragmentation insert, a removable breaching insert, an initiator well insert, one or more initiator adapter nuts, and an energetic material packing tool. The main body comprises an internal energetic material receiving compartment, a first and second tripod mount, a threaded adapter, and a pair of pin receivers, while the front cover comprises an internal removable insert compartment. The main body and front cover are held together with a multi-position adjustable toothed locking interface that adjustably permits the cover to intimately contact the energetic material when the internal removable insert compartment contains a fragmentation insert, a breaching insert, or no insert at all. A method of use is also provided. The method comprises: providing a removable energetic material, a molded plastic shell comprising a main body and a front cover, one or more removable inserts, an initiator well insert, an initiator insert, and one or more initiator adapter nuts, inserting said removable insert into the front cover; threading the initiator well insert into the plastic shell, cutting a length of the energetic material and inserting the energetic material into the main body; tightly packing the energetic material around the well insert and uniformly packing the energetic material with a C4 tool; affixing the front cover to the main body by compressing until firmly seated; selecting the adapter nut, removing the initiator well insert from the main body, inserting the initiator insert into the adapter nut, and threading the adapter nut onto the initiator well.

According to an illustrative embodiment of the present disclosure, it is an object of the invention to provide a directional charge system with a modular suite of energetic options that can be optimized to solve many of the situations encountered during a mission.

According to a further illustrative embodiment of the present disclosure, it is an object of the invention to provide a directional charge system that allows the user to tailor the munition to the task, which can limit collateral damage.

According to a yet another illustrative embodiment of the present disclosure, it is an object of the invention to provide a directional charge system that is transported in an inert manner to reduce the chance of inadvertent initiation due to enemy combatant munitions.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, disclosed is a modular directional charge system that includes a removable energetic material, a molded plastic shell comprising a main body and a front cover, a removable fragmentation insert, a removable breaching insert, an initiator well insert, one or more initiator adapter nuts, and an energetic material packing tool. The main body comprises an internal energetic material receiving compartment, a first and second tripod mount, a threaded adapter, and a pair of pin receivers. The front cover comprises an internal removable insert compartment. The main body and front cover are held together with a multi-position adjustable toothed locking interface that adjustably permits the cover to intimately contact the energetic material and removable insert (if present).

Figure 1:
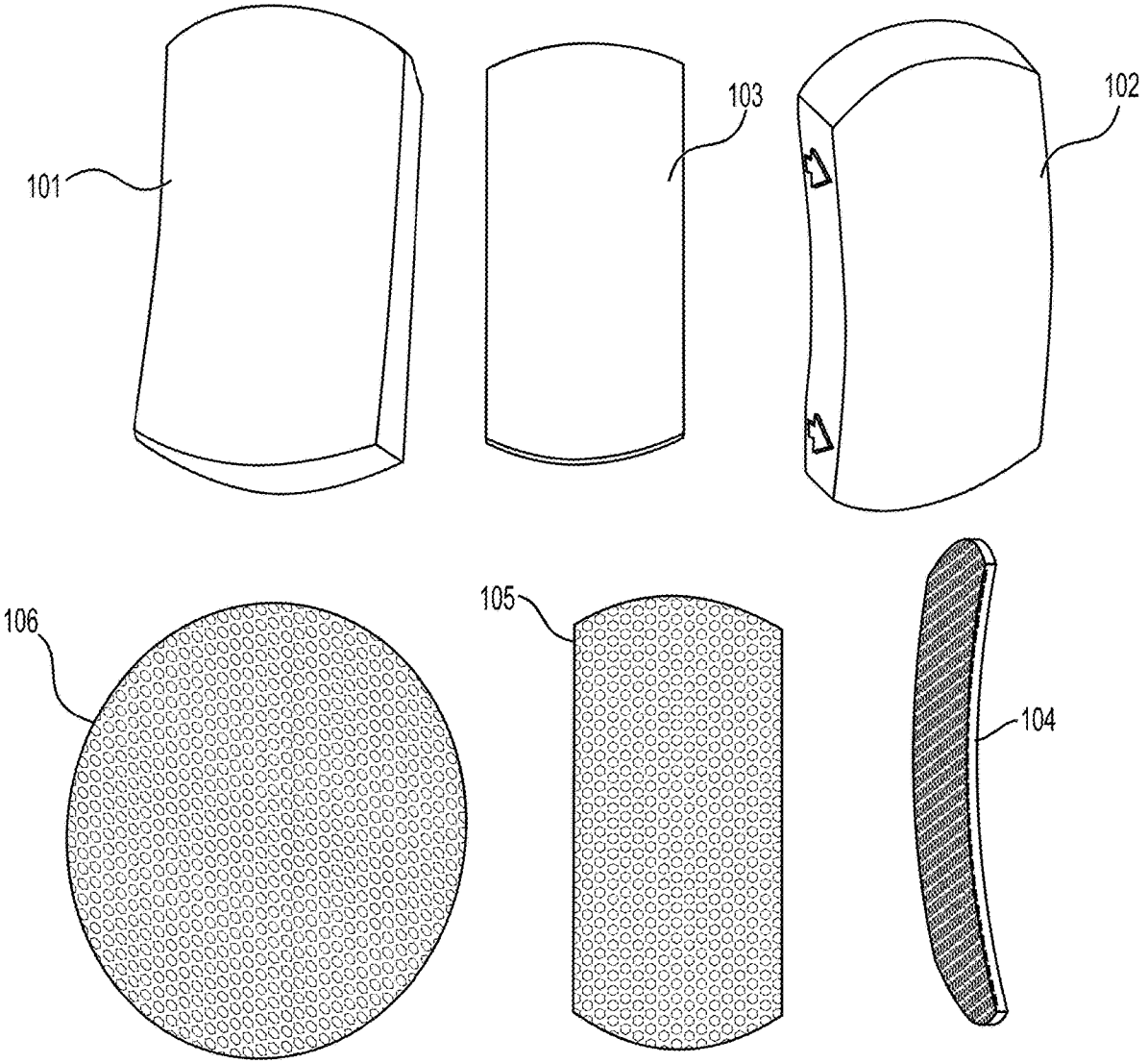
FIG. 1 shows an overhead view of the components of the modular directional charge system.

FIG. 1 shows an overhead view of the components of the modular directional charge system. The primary component is a molded plastic shell comprising a main body 101 and front cover 102. The main body 101 and front cover 102 are held together by an adjustable toothed securing mechanism (shown below) that allows the front cover 102 to securely hold the various materials in intimate contact with an energetic material 103. The plastic shell is designed to be loaded with an energetic material 103, such as one quarter of a standard M112 block of C4 explosive. The various components can be assembled in different configurations depending on the target. One example is a rubber insert 104 that can be used to breach doors or walls. Another is a steel plate insert 105 that is designed to enhance fragmentation, thus providing an anti-personnel mode. Additionally, the use of the loaded plastic shell without an insert to provide an overpressure blast to structures or barricaded enemy combatants is also contemplated. Appliques for training purposes 106 that provide a visual/audible indication of successful initiation may also be included, or a separate trainer device may be provided.

Figure 2:
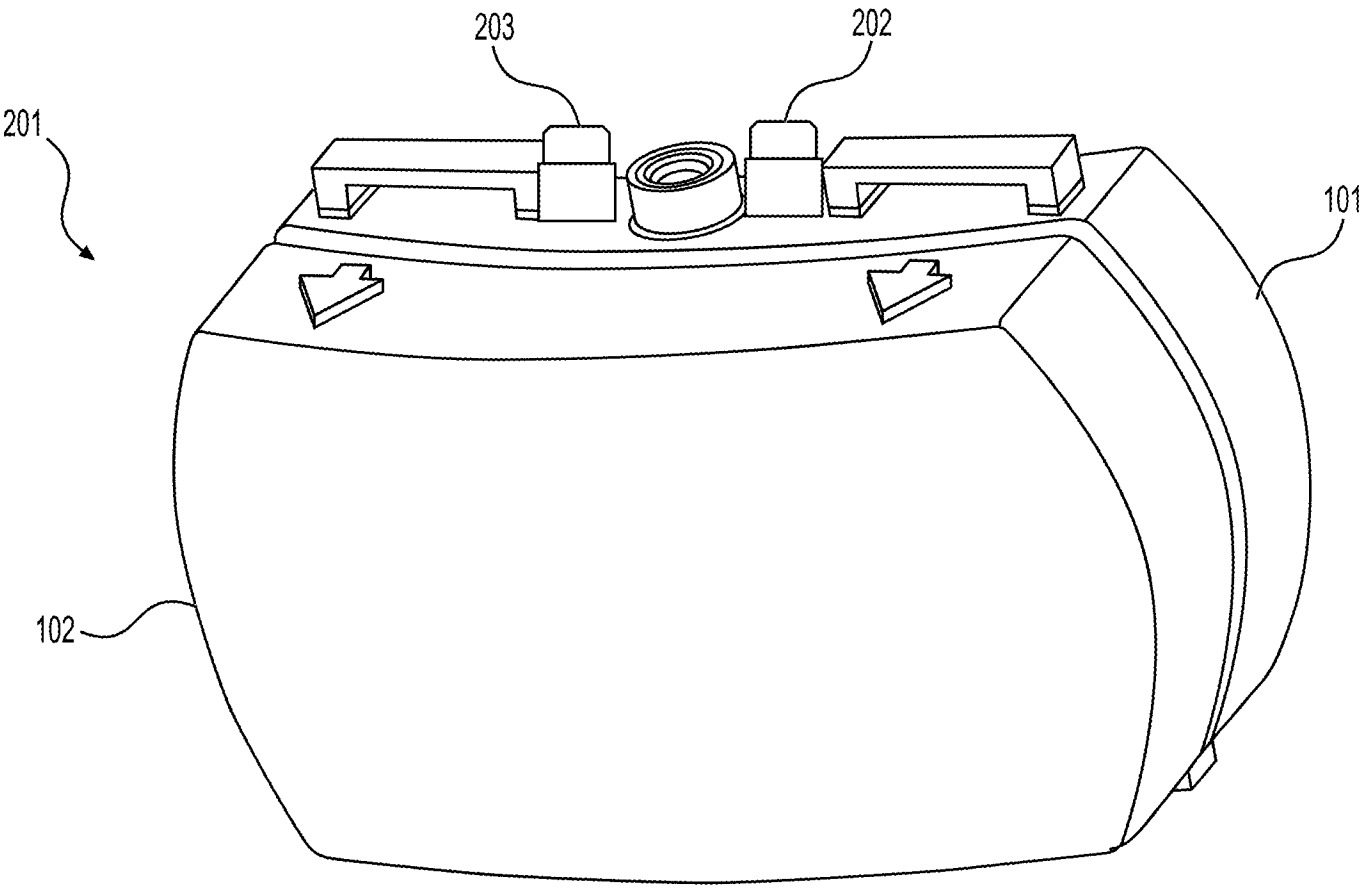
FIG. 2 shows a perspective view of the front side of the molded plastic shell.

FIG. 2 shows a perspective view of the front side of the molded plastic shell 201. The front cover 102 can include markings that are found on a typical directional charge, such as "Front Toward Enemy". While the inventive device resembles a miniature version of the standard M18A1 Claymore munition, it differs in multiple ways. Unlike the Claymore, it is not loaded with energetic material until the user is ready to deploy it. A conventional Claymore that is known and used is preassembled and provided to a user in a ready-to-use configuration. The inventive device can be customized with a desired insert and/or type and/or quantity of energetic material. Once the desired materials are inserted into the main body 101, the front cover is secured in position and the device is used in a similar manner to a standard Claymore munition. Also shown are the initiator well inserts 202 and initiator adapter nuts 203.

Figure 3:
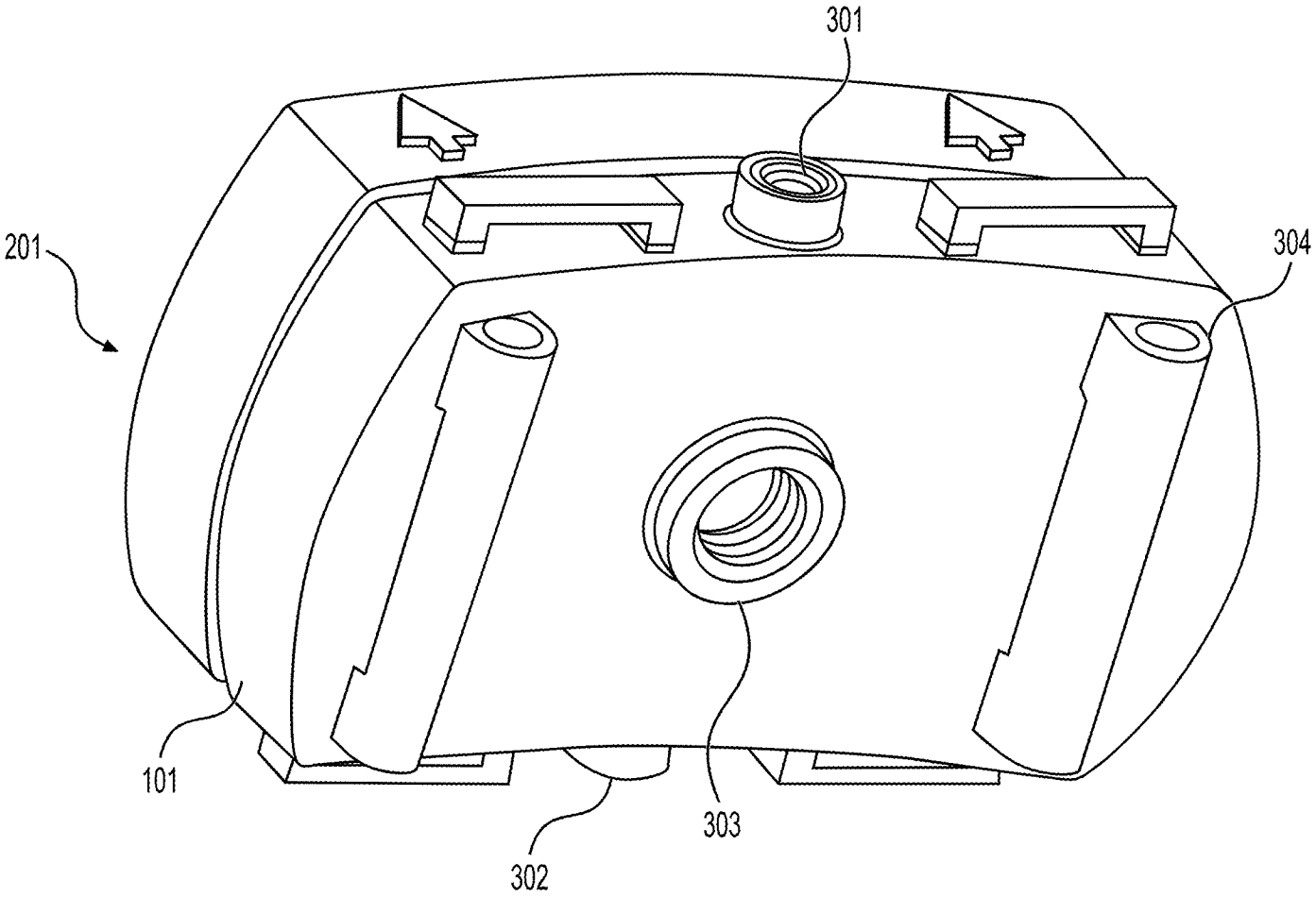
FIG. 3 shows a perspective view of the rear side of the molded plastic shell.

FIG. 3 shows a perspective view of the rear side of the molded plastic shell 201. The main body 101 further comprises a top, a bottom, a rear side, an internal energetic material receiving compartment (shown below), a first tripod mount 301 on the top, a second tripod mount 302 on the bottom, a threaded adapter 303 and a pair of pin receivers 304 on the rear side. The first and second tripod mounts 301, 302 allow the inventive device to be set up for use in a variety of ways by permitting attachment of a standard tripod in various locations. The threaded adapter 303 permits the use of various initiation methods that are well understood in the art. Mount types include: tripod, Unmanned Ground Vehicle, Unmanned Aerial Vehicle, magnetic mount, molle, and the like. The pair of pin receivers 304 allows for the insertion of one or more U-Pins to enable two or more plastic shells 201 to be linked together. Alternately, straps or zip ties can be inserted through the pin receivers 304 for use with alternate attachment means.

Figure 4:
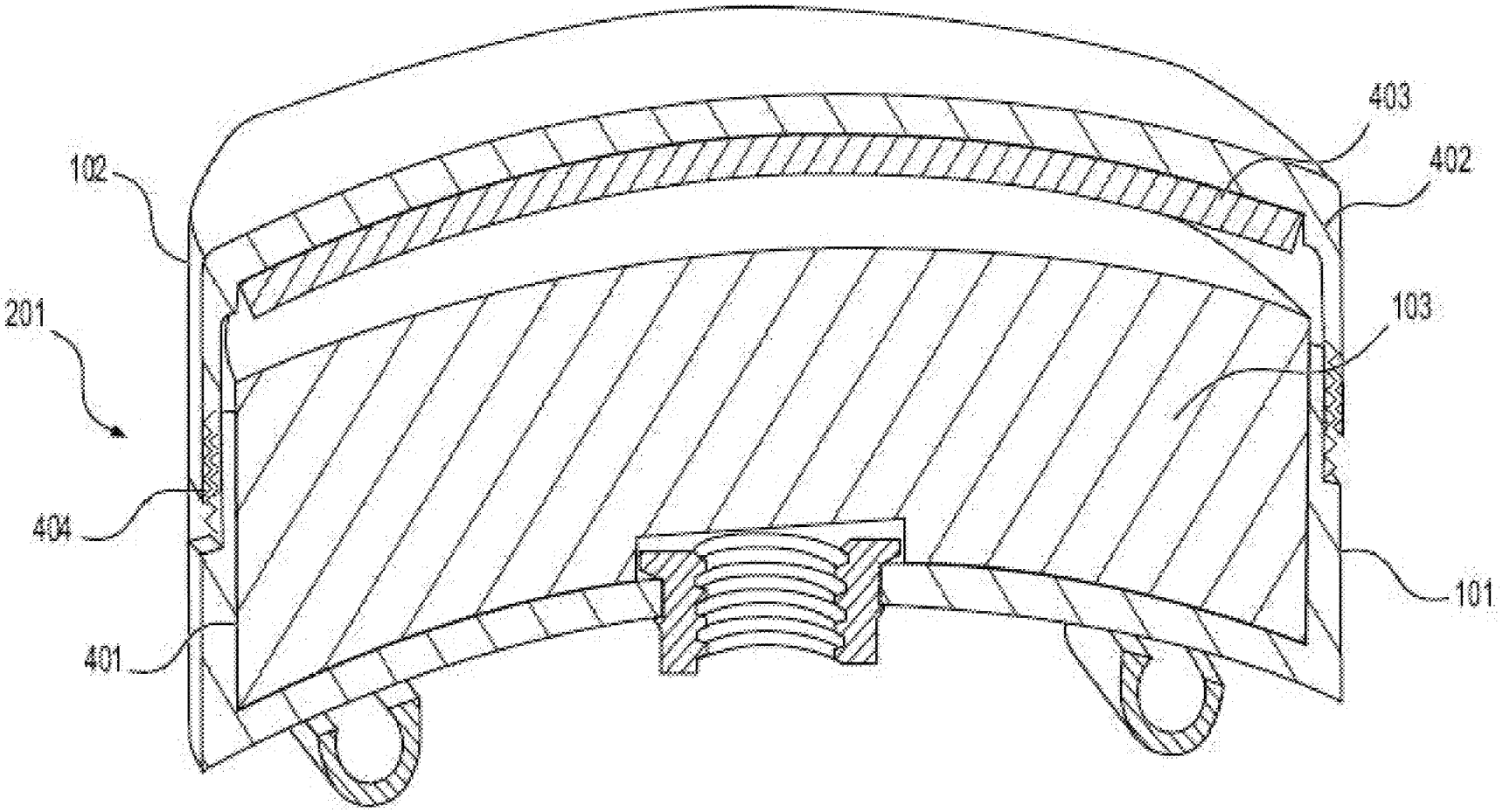
FIG. 4 shows a cutaway view of the interior of the molded plastic shell.

FIG. 4 shows a cutaway view of the interior of the molded plastic shell 201. The main body 101 comprises an internal energetic material receiving compartment 401 designed to be loaded with an energetic material 103, such as one quarter of a standard M112 block of C4 explosive. A major advantage of C4 is that it can easily be molded into any desired shape, such as the energetic material receiving compartment 401. C4 is very stable and insensitive to most physical shocks, cannot be detonated by a gunshot or by dropping, and does not explode when set on fire or exposed to microwave radiation. Since detonation can only be initiated by a combination of extreme heat and a shockwave, such as when a detonator is inserted into it and fired, the components of the inventive device can be transported in an inert manner prior to assembly. As can be appreciated, inert transport of the device reduces the chance on inadvertent initiation.

The front cover 102 comprises an internal removable insert compartment 402 for receiving a plate 403, such as a rubber applique for breaching doors or walls, a steel plate that enhances fragmentation, and the like. The main body 101 and front cover 102 are held together with a multi-position adjustable toothed locking interface 404 that adjustably permits the front cover 102 to securely hold the plate 403 in intimate contact with the energetic material 404. The locking interface 404 enables the main body 101 and front cover 102 to be secured at varying positions, which increases or decreases the internal volume of the molded plastic shell 201 depending on the contents thereof.

Figure 5:
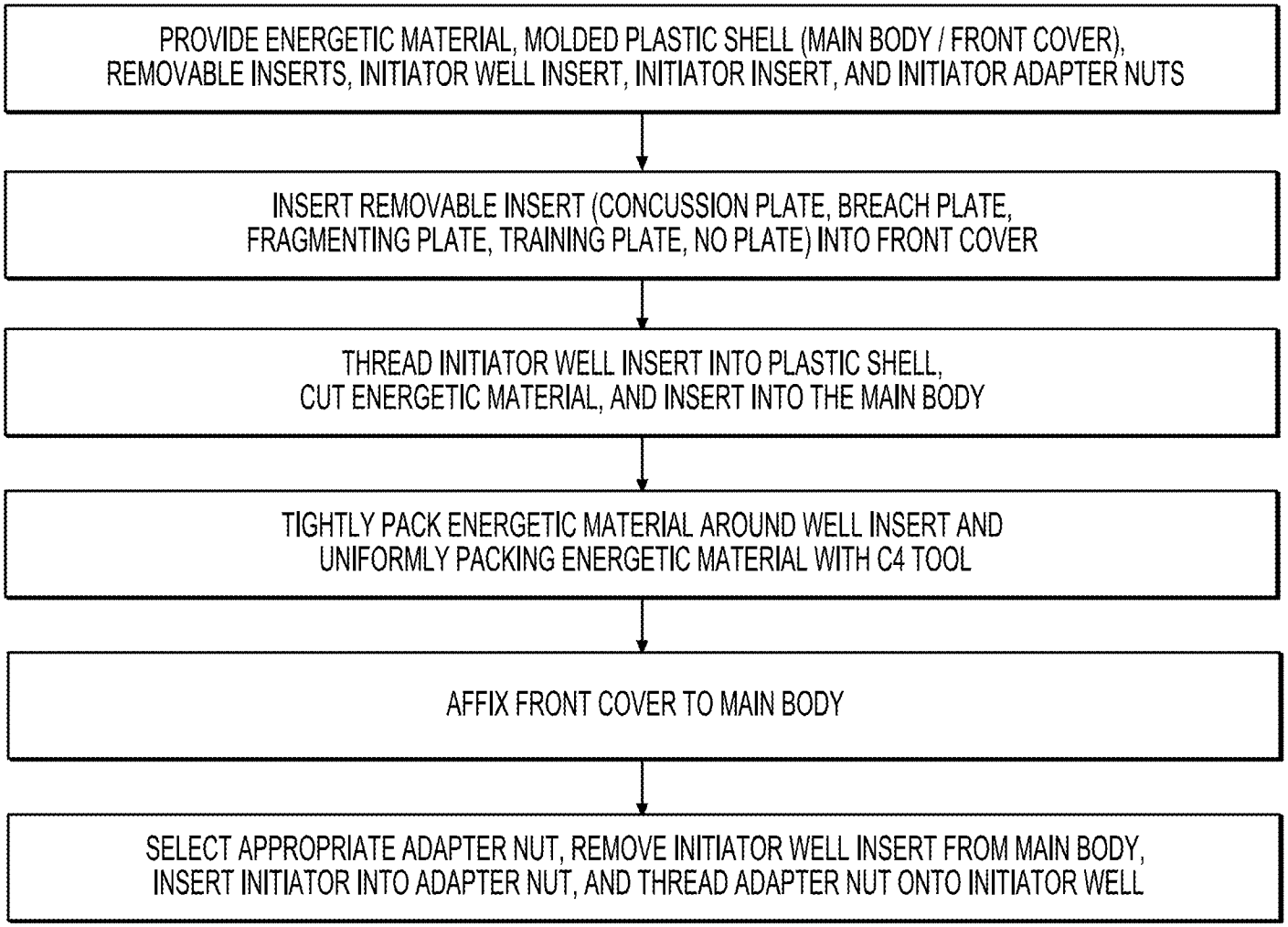
FIG. 5 shows a flow chart illustrating the method of use.

FIG. 5 shows a flow chart illustrating the method of use. The method comprises: providing a removable energetic material, a molded plastic shell comprising a main body and a front cover, one or more removable inserts, an initiator well insert, an initiator insert, and one or more initiator adapter nuts, inserting said removable insert into the front cover; threading the initiator well insert into the plastic shell, cutting a length of the energetic material and inserting the energetic material into the main body; tightly packing the energetic material around the well insert and uniformly packing the energetic material with a C4 tool; affixing the front cover to the main body by compressing until firmly seated; selecting the adapter nut, removing the initiator well insert from the main body, inserting the initiator insert into the adapter nut, and threading the adapter nut onto the initiator well.

Although the invention has been described in detail with reference to certain preferred embodiments, variations and modifications exist within the spirit and scope of the invention as described and defined in the following claims.

The invention claimed is:

1. A modular directional charge system comprising:

a removable energetic material, a molded plastic shell comprising a main body and a front cover, one or more removable inserts, an initiator well insert, an initiator insert, and one or more initiator adapter nuts;

said main body further comprising a top, a bottom, a rear side, an internal energetic material receiving compartment, a first tripod mount on said top, a second tripod mount on said bottom, a threaded adapter and a pair of pin receivers on said rear side;

said front cover further comprising an internal removable insert compartment;

wherein said main body and said front cover are held together with a multi-position adjustable toothed locking interface that adjustably causes said cover to retain said removable insert in intimate contact with said energetic material, or that adjustably causes said cover to retain intimate contact with said energetic material when no removable insert is present.

2. The system of claim 1, wherein said one or more removable inserts is selected from the group consisting of a rubber door breaching insert, a steel plate fragmentation enhancing insert, and a training plate comprising a visual/audible indication of successful initiation.

3. A method of using a modular directional charge comprising:

providing a removable energetic material, a molded plastic shell comprising a main body and a front cover, one or more removable inserts, an initiator well insert, an initiator insert, and one or more initiator adapter nuts;

inserting said removable insert into said front cover;

threading said initiator well insert into said plastic shell, cutting a length of said energetic material and inserting said energetic material into said main body;

tightly packing said energetic material around said well insert and uniformly packing the energetic material with a C4 tool;

affixing said front cover to said main body by compressing until firmly seated and locking said front cover to said main body using a multi-position adjustable toothed locking interface;

selecting said adapter nut, removing said initiator well insert from said main body, inserting said initiator insert into said adapter nut, and threading said adapter nut onto said initiator well.

4. The method of claim 3, wherein said method further comprises providing a rubber door breaching insert, a steel plate fragmentation enhancing insert, and a training plate comprising a visual/audible indication of successful initiation.

5. The method of claim 3, wherein said one or more removable inserts is selected from the group consisting of a rubber door breaching insert, a steel plate fragmentation enhancing insert, and a training plate comprising a visual/audible indication of successful initiation.

6. A modular directional charge system comprising:

a removable energetic material, a molded plastic shell comprising a main body and a front cover, one or more removable inserts, an initiator well insert, an initiator insert, and one or more initiator adapter nuts;

said front cover further comprising an internal removable insert compartment;

wherein said main body and said front cover are held together with an adjustable toothed locking interface that adjustably causes said cover to retain said removable insert in intimate contact with said energetic material, or that adjustably causes said cover to retain intimate contact with said energetic material when no removable insert is present.

7. The system of claim 6, wherein said main body further comprising a top, a bottom, a rear side, an internal energetic material receiving compartment, a first tripod mount on said top, a second tripod mount on said bottom, a threaded adapter and a pair of pin receivers on said rear side.

8. The system of claim 6, wherein said system further comprises a rubber door breaching insert, a steel plate fragmentation enhancing insert, and a training plate comprising a visual/audible indication of successful initiation.

* * * * *